United States Patent [19]

Watson

[11] Patent Number: 5,016,366

[45] Date of Patent: May 21, 1991

[54] SNOW RIDGER

[76] Inventor: David E. Watson, P.O. Box 608, Oxbow, Saskatchewan, Canada, S0C 2B0

[21] Appl. No.: 431,230

[22] Filed: Nov. 3, 1989

[30] Foreign Application Priority Data

Nov. 16, 1988 [CA] Canada ..... 583301

[51] Int. Cl.[5] ..... E01C 19/22

[52] U.S. Cl. ..... 37/220; 37/98; 37/277; 172/701

[58] Field of Search ..... 37/219, 270–273, 37/276, 283, 277, 98, 207, 220; 172/247, 684.5, 701, 303

[56] References Cited

U.S. PATENT DOCUMENTS

| | | | |
|---|---|---|---|
| 115,492 | 12/1908 | Olsen | 83/719 |
| 325,414 | 8/1932 | Overholt | 408/124 X |
| 333,006 | 12/1885 | Greenlees | 37/271 |
| 460,761 | 10/1891 | Ruggles | 37/271 |
| 530,614 | 12/1894 | Burnham | 37/269 |
| 801,090 | 10/1905 | Kenney | 37/277 |
| 845,549 | 2/1907 | Henry | 37/277 |
| 992,871 | 5/1911 | Harvey | 37/241 |
| 1,016,998 | 2/1912 | Johanning et al. | 37/98 |
| 1,331,382 | 2/1920 | Rolland | 171/247 |
| 2,197,307 | 4/1940 | Jenkins | 37/277 |
| 2,315,743 | 4/1943 | Sieg | 37/277 |

FOREIGN PATENT DOCUMENTS

| | | |
|---|---|---|
| 206211 | 10/1920 | Canada . |
| 712802 | 7/1965 | Canada . |
| 744945 | 10/1966 | Canada . |
| 968944 | 6/1975 | Canada . |

*Primary Examiner*—David H. Corbin
*Assistant Examiner*—Franco S. DeLiguori
*Attorney, Agent, or Firm*—Murray E. Thrift; Stanley G. Ade; Adrian D. Battison

[57] ABSTRACT

A method and an apparatus for producing ridges on snow covered fields are described. A row of snow is severed from the snow cover and elevated to provide a trench in the snow cover. The row is then deflected to one side of the trench and deposited on the undisturbed snow covering beside the trench. This produces a wind barrier on the snow covered field, reducing wind erosion of the snow cover. In preferred embodiments, two spaced trenches are cut and the rows of snow removed from them are placed on the undisturbed ridge of snow between them. In the apparatus, the rows of snow are severed, elevated and deposited by a support plate carried on two runners. The support plate floats on the undisturbed center ridge of snow. The two rows are deflected to side by side positions for deposit on top of the undisturbed center ridge by a pair of adjustable deflector plates. The two runners are supported on adjustable skis so that depth control is possible.

13 Claims, 4 Drawing Sheets

SNOW RIDGER

FIELD OF THE INVENTION

The present invention relates to snow management especially for agricultural purposes, and more particularly to a method and an apparatus for use in snow management.

BACKGROUND OF THE INVENTION

In agricultural fields, the amount of snow accumulated over a winter has a significant effect on the amount of moisture available for crop growth in the following growing season. In addition management of the snow accumulation can be used to control spring run-off, to increase water supplies to ponds and dugouts and to prevent the movement of snow off of fields into locations where it is not wanted. This can be achieved to some extent with the use of wind breaks and snow fencing. Other techniques used are leaving stubble, possibly in high strips, on a field to trap additional snow and the plowing of snow to produce snow banks at desired locations on the fields.

The present invention is concerned with a method and an apparatus for creating snow ridges across a snow covered landscape in order to control snow accumulation.

SUMMARY OF THE INVENTION

According to one aspect of the present invention there is provided a method for ridging a snow covering on a landscape, comprising:

continuously severing a row of snow from the covering;

elevating the row of snow to a height above the surrounding snow covering to provide a trench in the snow covering;

deflecting the elevated row of snow to one side of the trench; and depositing the deflected row of snow on the snow covering beside the trench.

In preferred embodiments of the invention, two, spaced apart, parallel rows of snow are severed from the snow covering, simultaneously elevated, deflected towards one another and deposited on top of the ridge of snow between the two trenches formed by removing the rows of snow.

According to another aspect of the present invention there is provided an apparatus for ridging a snow covering on a landscape comprising:

support means supporting the apparatus for travel across the snow covering;

row severing means for severing at least one row of snow from the snow covering as the apparatus travels thereacross;

row elevating means for elevating the row to a height above the surrounding snow covering to leave an open trench in the snow covering; and row deflecting means for deflecting the elevated row to one side of the trench for deposition on the snow covering beside the trench.

As with the method, the preferred embodiment of the apparatus provides row severing means for simultaneously severing two spaced apart parallel rows from the snow covering. The row elevating means elevate the two rows and the row deflecting means deflect the rows towards one another for deposit side by side on top of the snow between the two trenches.

The ridging resulting from the use of the apparatus and the method provides a useful wind barrier in an open field. The use of relatively undisturbed snow as the base for the ridge allows the ridge to be built up higher than would be the case with a free flowing, pulverized mass as would be created with a conventional snow plow. In addition, the snow removed from the trenches is handled in a way that avoids excessive pulverization, again assuring a ridge of maximum height and relatively high stability.

BRIEF DESCRIPTION OF THE DRAWINGS

In the accompanying drawings, which illustrate exemplary embodiments of the present invention.

DETAILED DESCRIPTION

Figure 1:
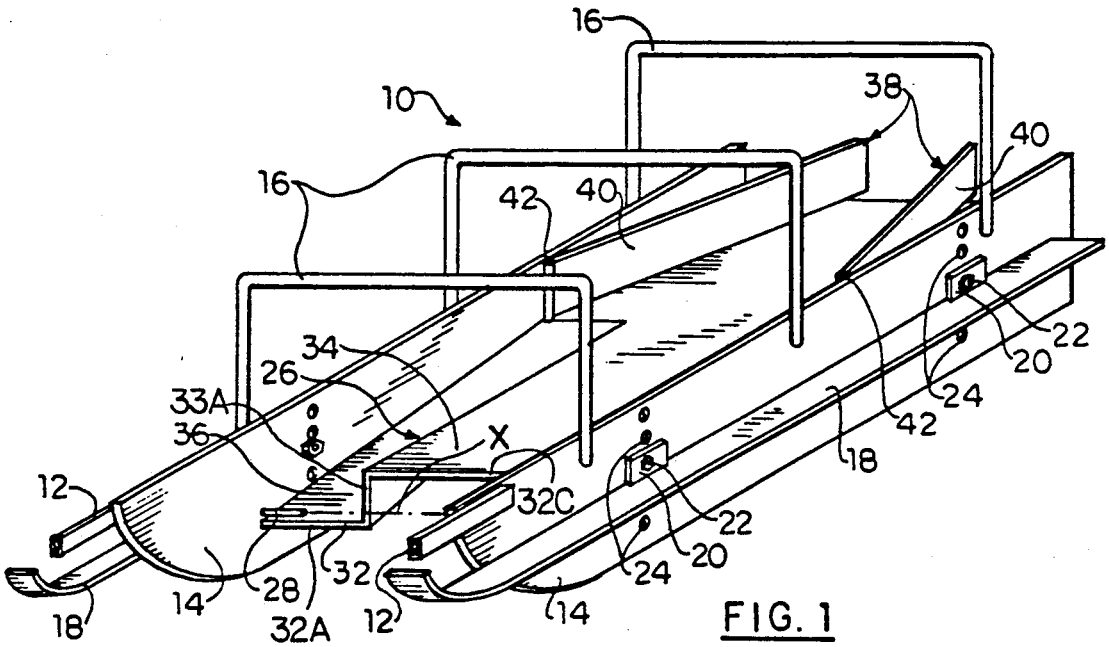
FIG. 1 is an isometric representation of one embodiment of a snow ridger according to the present invention.
Figure 2:
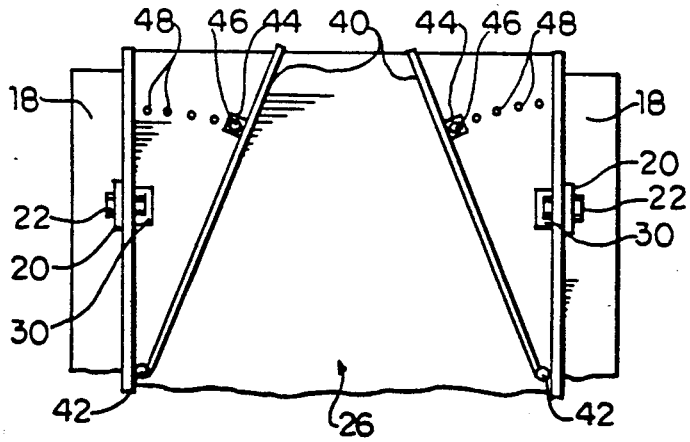
FIG. 2 is a partial plan view of the ridger in FIG. 1.

Referring to the accompanying drawings and especially to FIGS. 1 and 2, there is illustrated a snow ridger 10 with a drawbar structure partially illustrated by the beams 12. The drawbar is connected to a leading end of the ridger. It is of conventional construction and is intended for connection to a conventional three point hitch. The ridger includes a pair of spaced runners 14 that are vertically arranged plates with convexly curved leading edges running tangentially into the bottom edges of the plates. The runners are connected by rectangular hoops 16 that extend across the top of the device leaving a clear space between and above the runners. On the outside of each runner 14 is a ski 18 that is secured to the runner by two brackets 20 and respective bolts 22. The bolts extend through holes 24 in the runner, several which have been provided so that the skis can be adjusted up and down on the runners for depth control purposes.

Between the runners 14 is a generally horizontal support plate 26. The plate is pivotally mounted to the runners by respective pivot rods 28 secured to the plate near its leading edge. The support plate pivots freely about the lateral, horizontal axis x of the pivot rods. As illustrated in FIG. 2, notches 30 may be provided in the side edges of the support plate to clear the bolts 22 securing the skis 18 to the runners, where this is necessary.

The leading edge 32 of the support plate 26 is stepped to provide row severing means in the form of cutting edge portions 32A, 33A and 32B, 33B and an elevated centre section 32C therebetween. These provide the support plate with an elevated center section 34 and row elevating means in the form of elevating ramps 36 along its opposite sides, extending part way along the plate from the leading edge. Behind the ramps 36 is a row deflecting means. This includes two deflectors 38. Each deflector is a vertical plate 40 pivotally connected to the plate 26 by a vertical pin 42 adjacent the edge of the support plate 26 and at the leading edge of the deflector plate 40. The deflector plate 40 is also connected to the support plate 26 by a bracket 44 fixed to the deflector plate 40 and a bolt 46 extending through one of a series of holes 48 in the support plate 26. The holes 48 are arranged in an arc centered on the pin 42 so that the deflector plate 40 can be adjustably and positioned around the pin 42. As illustrated most particularly in FIG. 2, the deflector plates converge rearwardly to leave a center opening at the rear edge of support plate 26.

Figure 3:
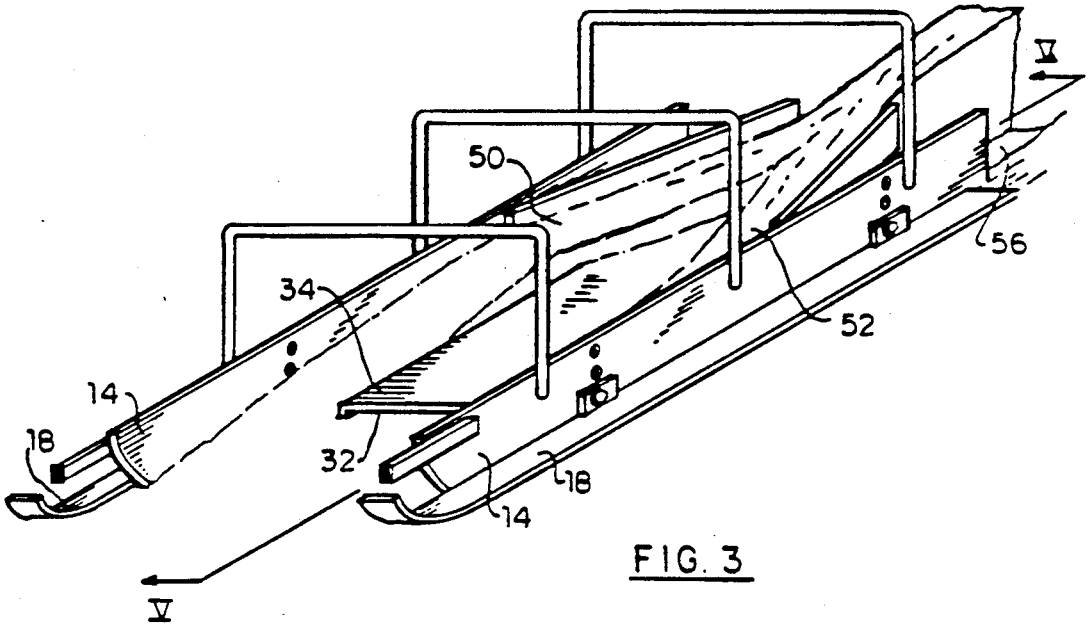
FIG. 3 is an isometric representation like FIG. 1 showing the ridger in use.
Figure 4:
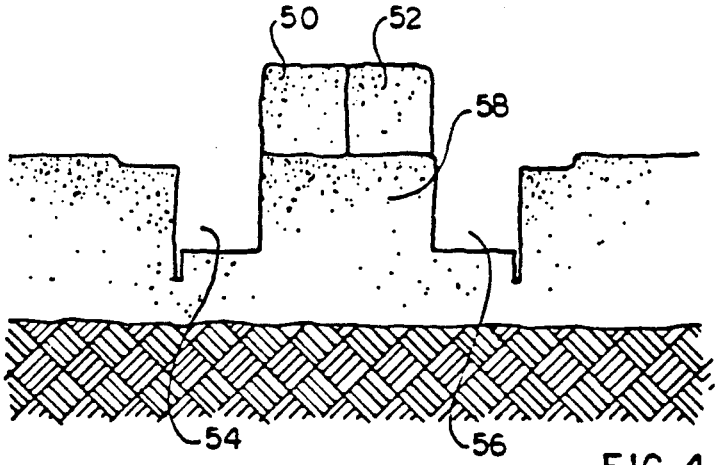
FIG. 4 is a cross sectional view of a ridged snow layer.
Figure 5:
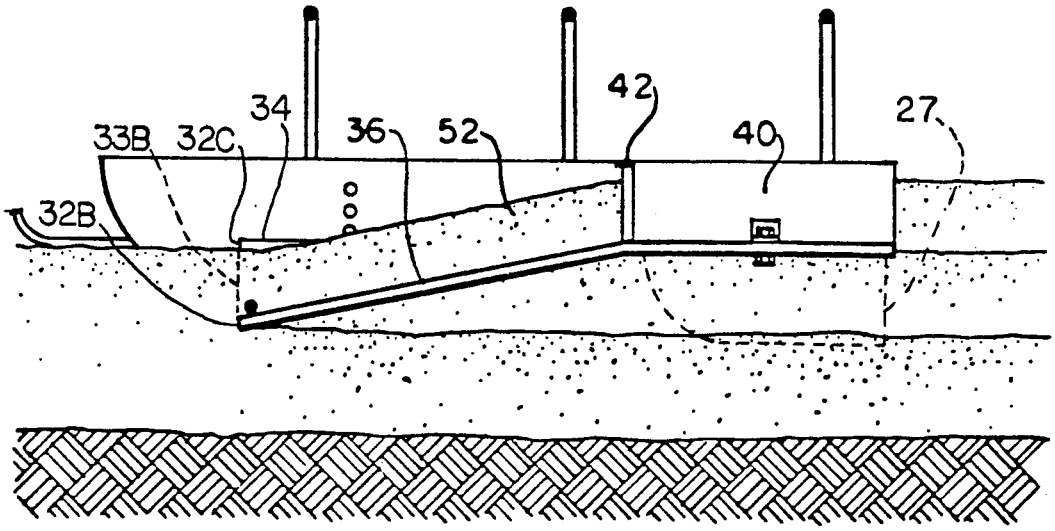
FIG. 5 is a sectional view along line V—V of FIG. 3.

The use of the apparatus is illustrated most particularly in FIGS. 3, 4 and 5.

When the ridger is drawn through the snow, it is supported by the two skis 18. The leading edge 32 of the plate 26 extends into the snow covering on opposite sides of the center section 34 and cooperates with the runners 14 to cut two, parallel, rectangular section rows 50 and 52 of snow from the snow cover. The depth of these rows is determined by the position of skis 18 and runners 14. The two severed rows of snow are elevated by the ramp sections 36 of the support plate 26 as the ridger is drawn through the snow. This leaves two parallel trenches 54 and 56, separated by a center ridge 58 of relatively undisturbed snow. The freely pivoting support plate 26 rides on the top of the ridge 58 without causing excessive disturbance to the snow constituting ridge. As the snow rows 50 and 52 engage the deflector plates 40, they are deflected towards one another to lie side by side where they leave the trailing edge of the support plate 26 and are deposited gently on top of the ridge 58 leaving a trench and ridge structure like that illustrated in FIG. 4.

Figure 6:
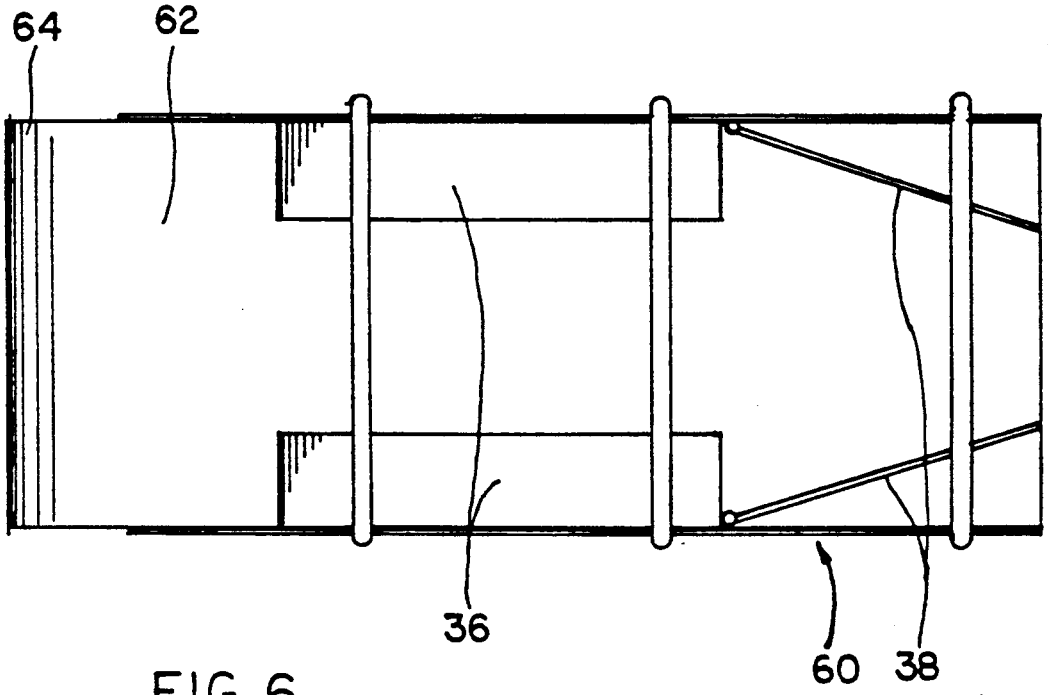
FIG. 6 is a plan view of an alternative embodiment of the ridger.

An alternative embodiment of ridger 60 is illustrated in FIG. 6, where the support plate 26 is replaced with a plate 62 that extends to the front of the runners and curves upwardly at 64. The ramps 36 and deflectors 38 are the same as those previously described. The extended plate 62 serves for depth control, so that skis 18 are not required.

The ridging method and apparatus of this invention enjoy significant advantages when compared with conventional snow plowing. A blade travelling through snow creates shear forces which break down the snow aggregates or lumps into smaller particles. Where this breakdown is severe, the snow is pulverized and resembles free flowing salt or sugar in consistency. If larger lumps of snow can be maintained, the snow can be used to construct a higher wind barrier and will have a greater resistance to wind erosion. With the present ridger, a relatively undisturbed strip is used as the base for the snow barrier. This allows the production of a higher barrier than would otherwise be the case. At the same time, the amount of snow actually transported is reduced compared with conventional snow plowing techniques so that less energy is expended.

The free floating feature of the support plate 26, with its rear end resting on and gliding along the central undisturbed snow layer, is of considerable value in minimizing snow disturbance and pulverization. It allows a gentle action in depositing the rows of snow on the top of the centre ridge. This is particularly useful when the snow layer is shallow and relatively fresh, as it may also be relatively fragile and more subject to pulverization. The low elevation angle of the blade, resulting from its rest position on a low central strip of snow, allows removed snow to move over the support plate with minimal pulverization and with reduced horsepower requirements as compared with those of a conventional snow plow. A similar action is provided by the support plate 62.

The horizontal adjustment of the two deflector plates 40 allows the two rows of snow lifted out of the trenches to be laid side by side, thus avoiding the excessive pulverization which might take place if these rows were forced together.

In some conditions, where the snow is soft, as it is early in the winter or after a fresh snowfall, the central ridge 58 may be disturbed by the floating plate 26 enough to cause a breakdown of the snow structure, thus lowering the strip and ultimately the ridge. This can be counteracted by the installation of stops on the runners 14 to engage the underside of the plate 26 and limit its downward pivotal movement. Alternatively, a support runner 27 may be secured to the underside of the support plate for limiting downwards pivotal movement of the support plate, as shown in broken line in FIG. 5.

While particular embodiment of the present invention have been described in the foregoing, it is to be understood that other embodiments are possible within the scope of the invention. Thus, for example, an apparatus may be provided that cuts a single trench in the snow cover, elevates the row of snow cut out and displaces it to one side of the trench. An embodiment of this sort may produce a high side draft which would limit its applicability. It is also possible to provide an apparatus where the elevated rows of snow are displaced to the outside of the two trenches rather than onto the center, thus providing two spaced snow ridges.

It is therefore to be understood that the present invention is to be construed as limited solely by the scope of the appended claims.

I claim:

1. An apparatus for ridging a snow covering on a landscape comprising:

support means supporting the apparatus for travel across the snow covering;

row severing means for simultaneously severing two, spaced apart, parallel rows of snow from the snow covering as the apparatus travels thereacross;

row elevating means for elevating the rows to a height above the surrounding snow covering to leave two spaced, parallel trenches in the snow covering; and row deflecting means for deflecting each of the elevated row of snow towards one another for deposition on the snow covering between the trenches.

2. Apparatus according to claim 1 wherein the row deflecting means comprises a support plate and deflecting plates upstanding from the support plate.

3. Apparatus according to claim 2 wherein the deflecting plates converge towards a rear edge of the support plate.

4. Apparatus according to claim 3 including means for adjusting the convergence of the deflecting plates.

5. Apparatus according to claim 3 wherein the row severing means comprise a leading edge of the support plate.

6. Apparatus according to claim 5 wherein the leading edge of the support plate has spaced cutting edge portions and a center portion therebetween elevated with respect to the cutting edge portions.

7. Apparatus according to claim 5 wherein the row elevating means comprise ram portions of the support plate on opposite sides of an elevated center section.

8. Apparatus according to claim 7 wherein the support plate is pivotally mounted on the support means for free pivotal movement about an axis substantially parallel to and adjacent the leading edge of the support plate.

9. Apparatus according to claim 8 wherein the deflecting plates have leading edges pivotally mounted on the support plate for pivotal movement of the deflecting plates about substantially vertical axes adjacent respective opposite side edges of the support plate.

10. Apparatus according to claim 8, including a support runner secured to the underside of the support plate for limiting downward pivotal movement of the support plate.

11. Apparatus according to claim 9 wherein the support means comprise a pair of runners on opposite sides of the support plate.

12. Apparatus according to claim 11 wherein the support means further comprise two skis mounted on respective ones of the runners.

13. Apparatus according to claim 12 including means for adjustably mounting the skis on the runners for vertical adjustment of the ski position thereon.

* * * * *